US008228243B1

(12) United States Patent
Rivera

(10) Patent No.: US 8,228,243 B1
(45) Date of Patent: Jul. 24, 2012

(54) PARALLEL PLATE ANTENNA

(75) Inventor: David F. Rivera, Westerly, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 339 days.

(21) Appl. No.: 12/587,328

(22) Filed: Sep. 30, 2009

(51) Int. Cl.
*H01Q 1/24* (2006.01)
*H01Q 1/48* (2006.01)

(52) U.S. Cl. ..... 343/702; 343/846

(58) Field of Classification Search ..... 343/878, 343/884, 890, 776–780, 784, 702, 846
See application file for complete search history.

(56) References Cited

U.S. PATENT DOCUMENTS 6,040,803 A * 3/2000 Spall ..... 343/700 MS
6,456,243 B1 * 9/2002 Poilasne et al. ..... 343/700 MS
2006/0055605 A1 * 3/2006 Peled et al. ..... 343/702

OTHER PUBLICATIONS

The American Radio Relay League. "Antenna Frequency Scaling." The ARRL Antenna Book. 15th Edition. Newington, CT. 1988, pp. 2-24 to 2-25.*

* cited by examiner

*Primary Examiner* — Hoang V Nguyen
*Assistant Examiner* — Amal Patel
(74) *Attorney, Agent, or Firm* — James M. Kasischke; Jean-Paul A. Nasser; Michael P. Stanley

(57) ABSTRACT

The invention as disclosed is a parallel plate antenna having a number of stacked horizontal plates and two vertical plates. Alternating ones of the horizontal plates are electrically coupled to one vertical plate such that the horizontal plates coupled to one vertical plate are interleaved with the horizontal plates coupled to the other vertical plate. The assembled antenna is mounted on a planar mounting flange. The height/width of the antenna is approximately $1/30^{th}$ of a wavelength at the frequency of operation.

1 Claim, 6 Drawing Sheets

PARALLEL PLATE ANTENNA

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

None.

BACKGROUND OF THE INVENTION (1) Field of the Invention

The present invention is directed to compact antennas. In particular, the present invention is directed to a compact antenna that has the ability to operate on or near electrically conducting surfaces.

(2) Description of the Prior Art

The shielding effectiveness (SE) of a metallic enclosure is an important figure of merit that describes the degree of protection against electromagnetic field leakage into or out of the structure. It is defined by a ratio in dB units by equation (1) as follows:

$$SE = 20\log\left|\frac{E_t}{E_i}\right| \tag{1}$$

Where $E_t$ is the electric field strength leaking into the shield, and $E_i$ is the incident field strength external to the shield. Both field strengths have units of volts per meter (V/m). The degree of protection against electromagnetic field leakage is particularly relevant to compact antennas whose design are in the nature of portable metallic enclosures and whose application requires the ability to operate on or near electrically conducting surfaces.

SUMMARY OF THE INVENTION

It is a general purpose and object of the present invention to provide an antenna design that operates on or near electrically conducting surfaces.

The above object is accomplished with the present invention through the use of a parallel plate antenna having a number of stacked horizontal plates and two vertical plates. Alternating ones of the horizontal plates are electrically coupled to one of the vertical plates such that the horizontal plates coupled to one vertical plate are interleaved with the horizontal plates coupled to the other vertical plate. The assembled antenna is mounted on a planar mounting flange. The height/width of the antenna is approximately $1/30^{th}$ of a wavelength at the frequency of operation.

BRIEF DESCRIPTION OF THE DRAWINGS

A more complete understanding of the invention and many of the attendant advantages thereto will be more readily appreciated by referring to the following detailed description when considered in conjunction with the accompanying drawings, wherein like reference numerals refer to like parts and wherein.

DETAILED DESCRIPTION OF THE INVENTION

Figure 1:
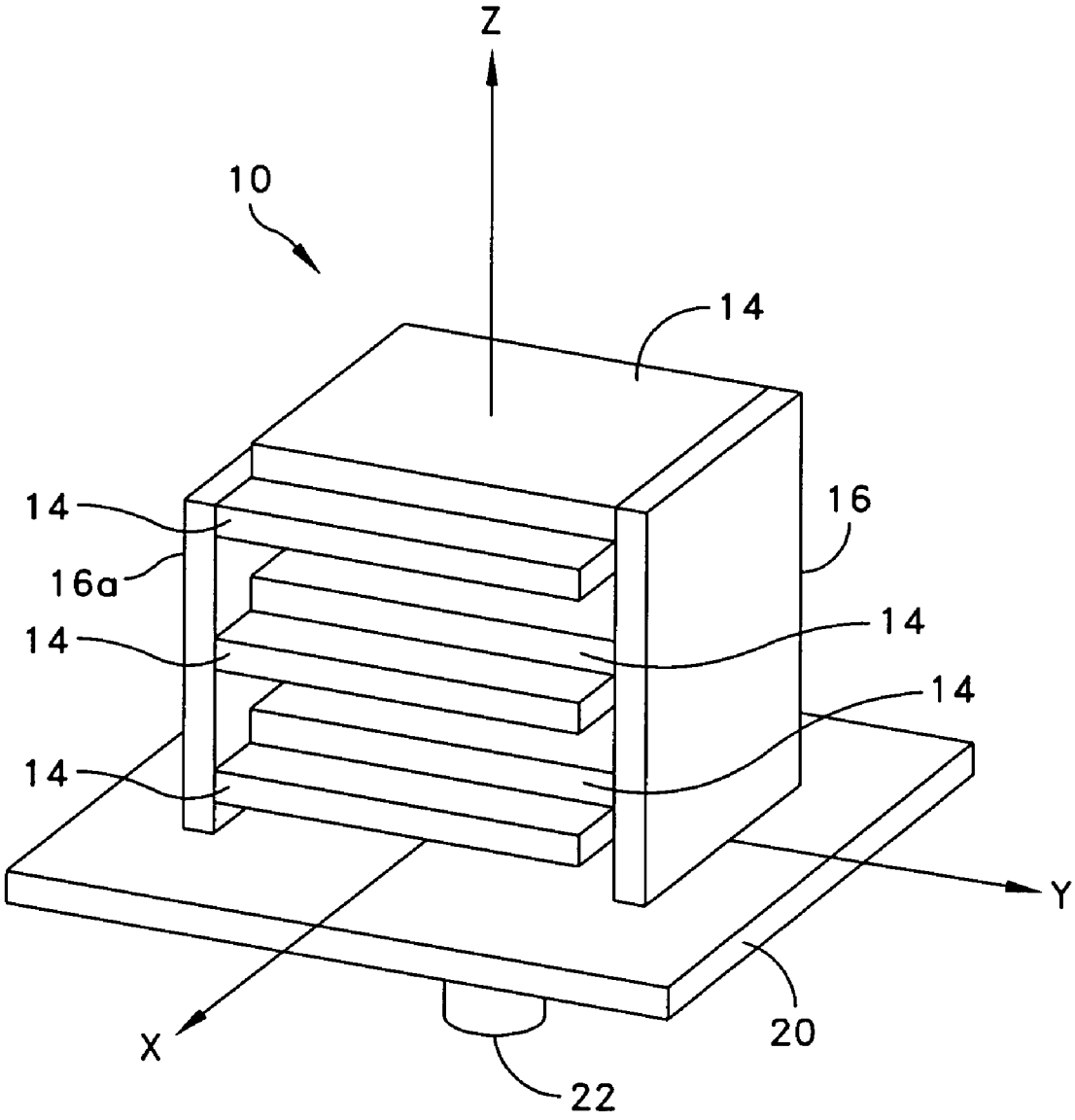
FIG. 1 illustrates a perspective view of the present invention antenna.
Figure 2:
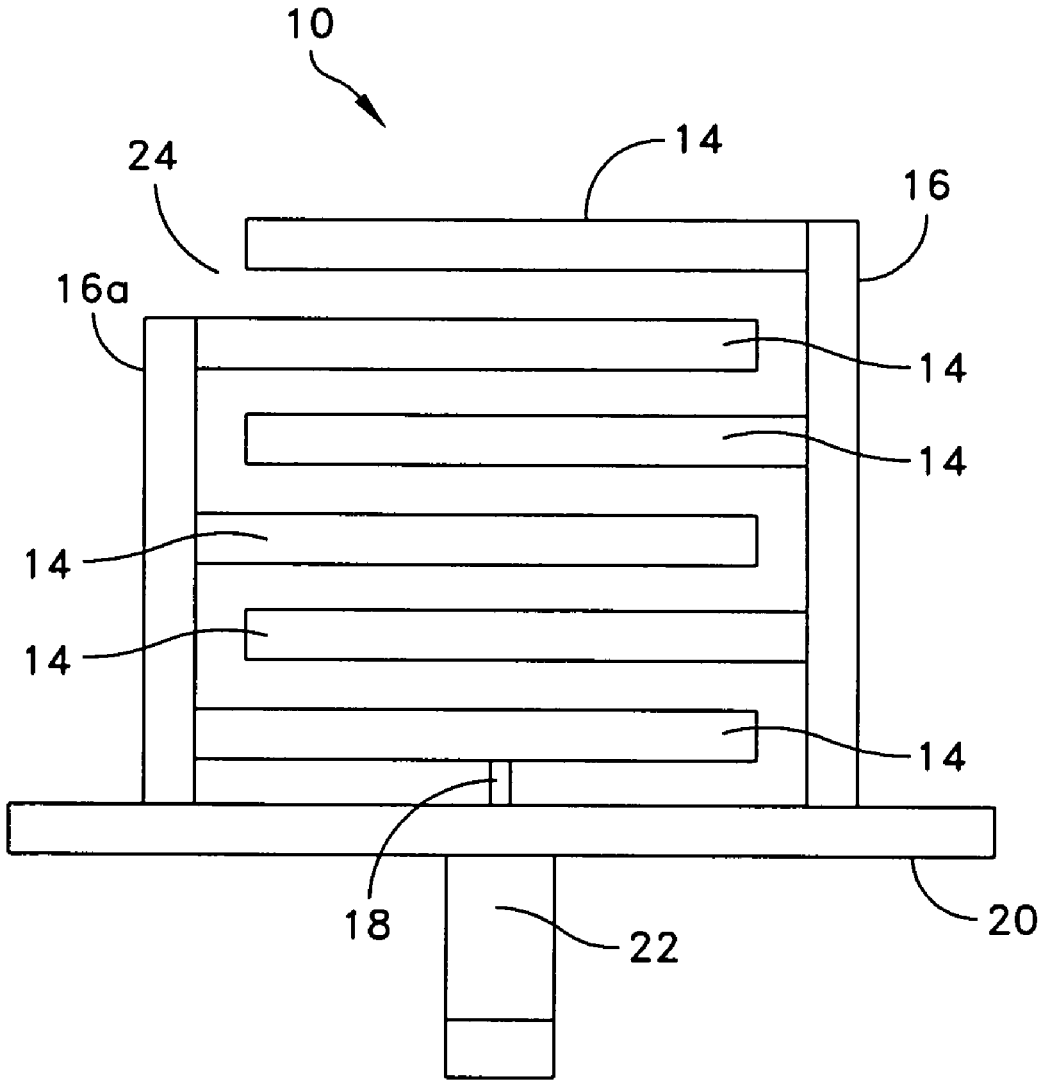
FIG. 2 illustrates a side view of the present invention antenna that includes details of the coaxial feed.

Referring to FIGS. 1 and 2 there is illustrated multiple views of the antenna 10 of the present invention. The antenna 10 is comprised of multiple conducting plates arranged in parallel both horizontally and vertically and referred to as horizontal plates 14 and vertical plates 16. The conducting plates 14 and 16 can be made from a conducting metal such as copper or a plastic material that is then plated with electrically conducting material. The height and width of the antenna 10 is approximately one-thirtieth of a wave length ($w \approx h \approx \lambda/30$) at a selected frequency of operation. The depth of the antenna is also of the same proportions relative to the wavelength, that is ($d \approx \lambda/30$). In a preferred embodiment the multiple conducting plates that are arranged horizontally 14 and parallel to each other are all rectangular shape and have the same spatial dimensions. In a preferred embodiment, the two vertical plates 16 are parallel to each other and are rectangular in shape. However, one is slightly larger than the other. The smaller vertical plate 16*a* allows for an aperture 24 at the top of the antenna 10. The horizontal plates 14 are connected at right angles alternately on each side of and between the two parallel vertical plates 16. The horizontal plates 14 are spaced an equal distance apart from each other. The horizontal plates 14 serve to tune the antenna 10 to the selected operating frequency. In a preferred embodiment, six horizontal plates 14 are sufficient to enable tuning to the selected frequency. The two vertical conducting plates 16 are mounted perpendicular on a mounting flange 20. A coaxial feed 22 is joined to the base of antenna 10 at the center of the mounting flange 20. The center pin or feed probe 18 of the coaxial feed 22 protrudes from the mounting flange 20 to the lowest horizontal plate 14.

Figure 3:
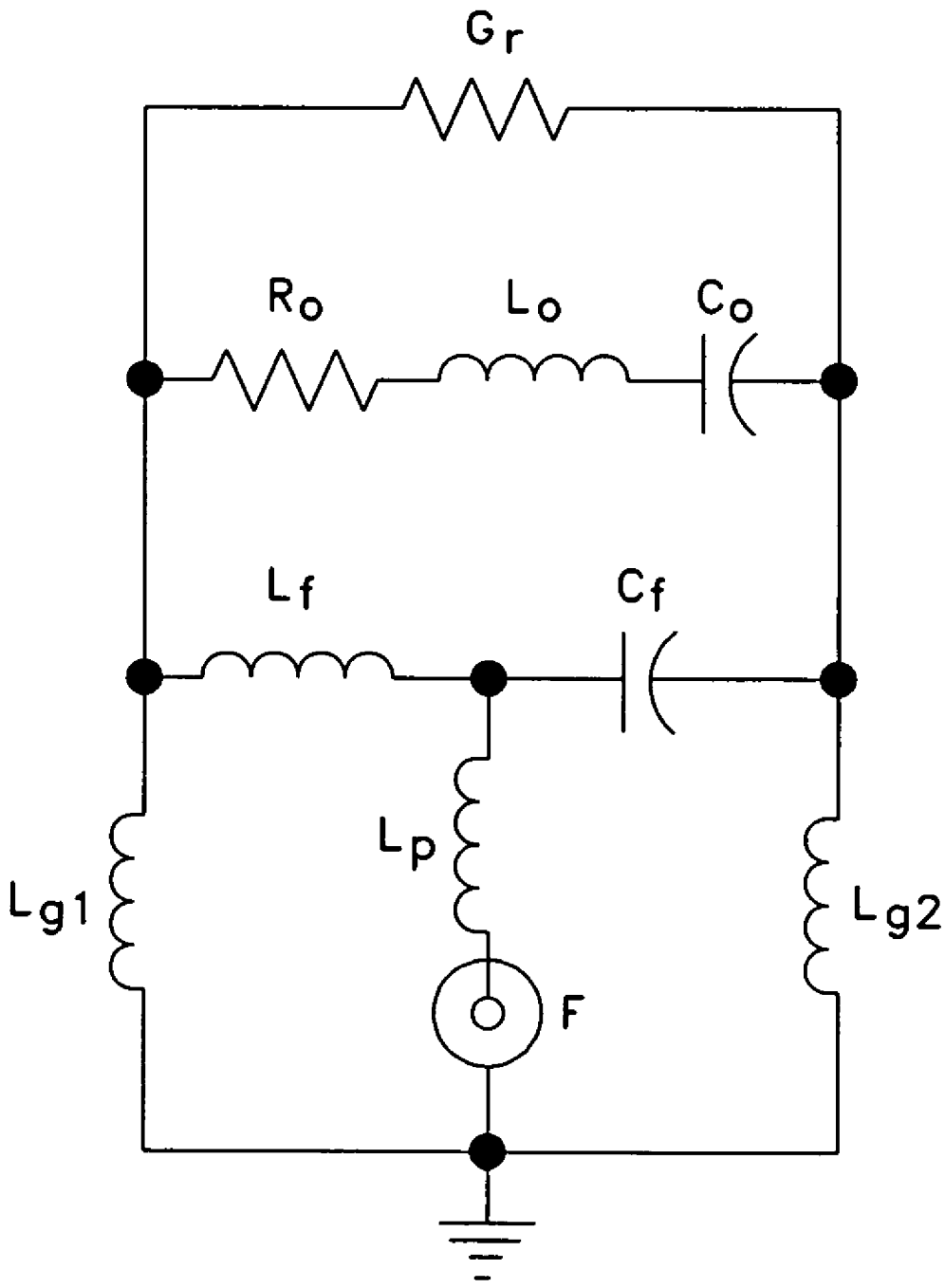
FIG. 3 illustrates an approximate electrical equivalent circuit of the present invention antenna.

Referring to FIG. 3, there is illustrated an approximate electrical equivalent circuit of the antenna 10 as presented, wherein the feed-point is denoted by F. In the circuit, inductances $L_{g1}$, $L_{g2}$, $L_p$ represent inductances of the vertical conducting plates 16 and the feed probe 18 respectively. Inductance $L_f$ and capacitance $C_f$ are associated with the feed connection 22. The series circuit comprising resistor $R_o$, capacitor $C_o$ and inductance $L_o$ represent the effects of the ohmic resistance of the horizontal plates 14, the capacitance between the plates 14, and the self and mutual inductance of the plates 14 respectively. The conductance $G_r$ represents the conductance due to the radiating portion of the antenna 10, located in the region of the aperture 24 at the top of the antenna 10.

With the coaxial feed probe 18 at the base of the antenna 10, an alternating electromagnetic field is established between the adjacent horizontal parallel plates 14 that permit the propagation of electromagnetic field to the aperture 24. The power flow in the horizontal parallel plates 14 energizes the aperture 24, setting up an electromagnetic field that is radiated outward and away from the antenna 10. The power of the electromagnetic field is proportional to the radiation conductance Gr, which depends on the physical dimensions of the aperture 24.

Figure 7:
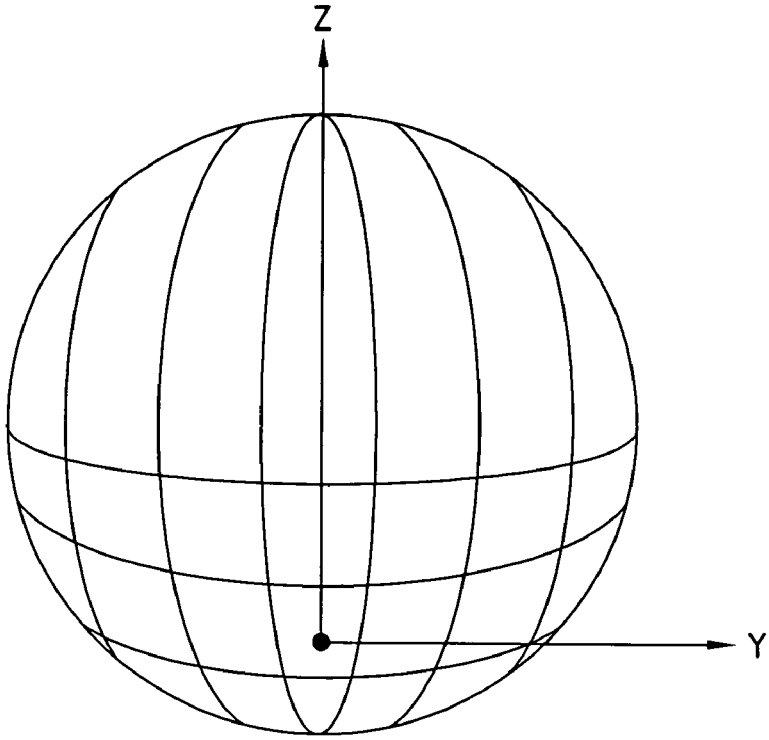
FIG. 7 illustrates the Y-Z plane radiation pattern of the antenna situated on a conducting plane.
Figure 4:
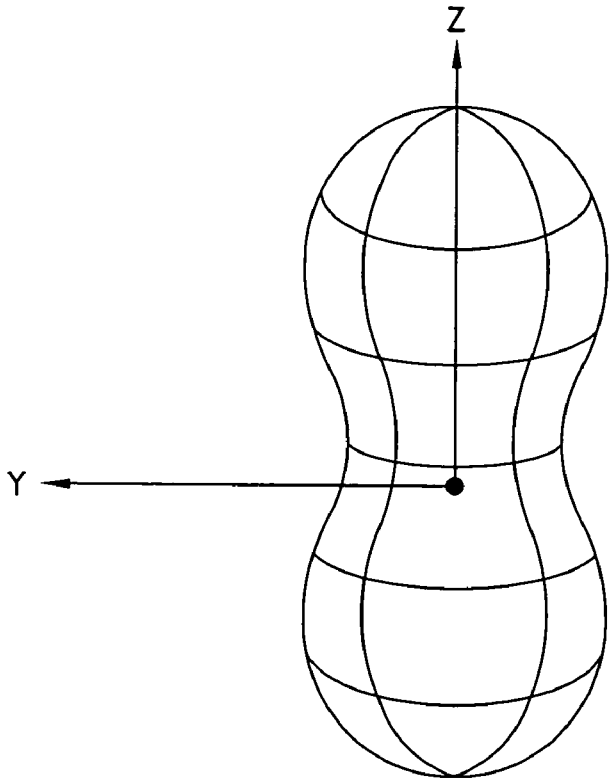
FIG. 4 illustrates the X-Y plane radiation pattern of the present invention antenna according to the orientation of the antenna in FIG. 1.
Figure 5:
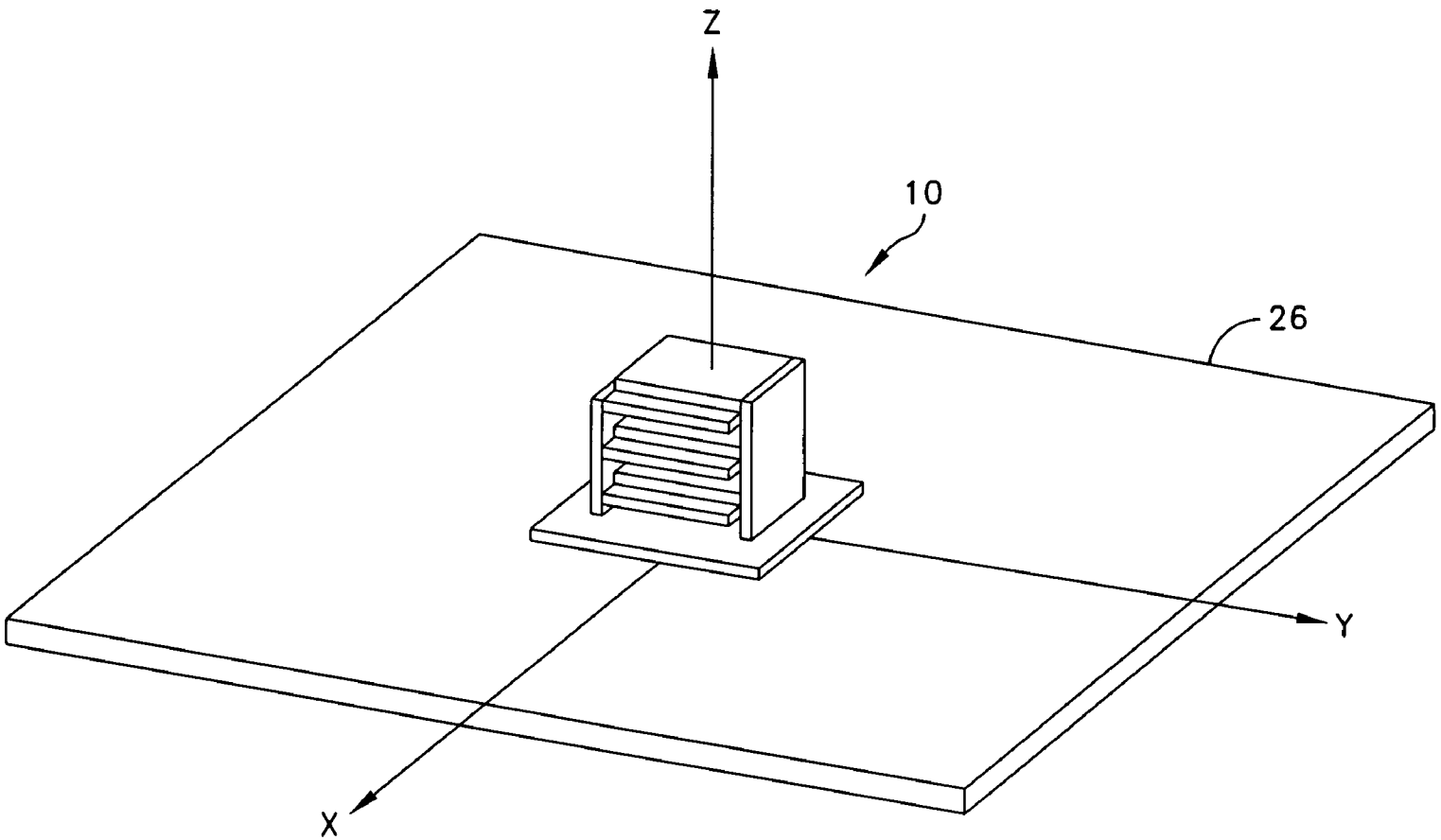
FIG. 5 illustrates the antenna of the present invention situated on a conducting plane.
Figure 6:
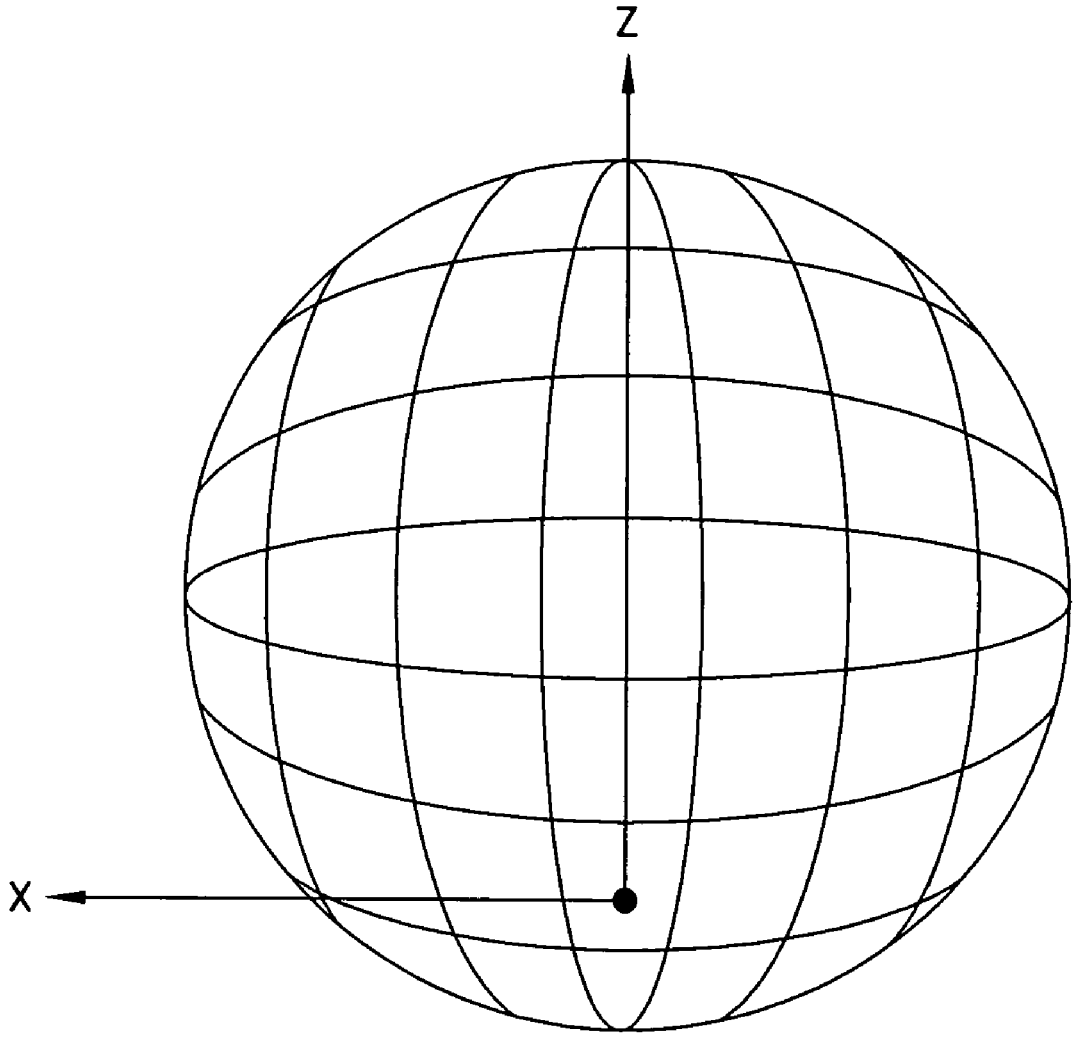
FIG. 6 illustrates the X-Y plane radiation pattern of the antenna situated on a conducting plane.

The effectiveness of antenna 10 is demonstrated in its performance when situated near a conducting surface. Referring to FIG. 4, there is illustrated the X-Y plane radiation pattern of the antenna 10 based on the orientation of the antenna in FIG. 1. When antenna 10 is situated on a conducting plane 26, as illustrated in FIG. 5, the pattern is hemispherical in shape as illustrated in FIGS. 6 and 7.

The advantage of the present invention is that this antenna design provides a compact antenna capable of operation near a metallic surface, and amenable to fabrication techniques such as molding or extrusion.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

What is claimed is:

1. An antenna comprising:

a mounting flange that serves as a ground plane;

a first vertical conducting plate joined normal to said mounting flange;

a second vertical conducting plate joined normal to said mounting flange and parallel to said first vertical conducting plate, wherein said second vertical conducting plate is longer than said first vertical conducting plate;

a first plurality of parallel horizontal conducting plates joined to said first vertical conducting plate at right angles, between said first vertical conducting plate and said second vertical conducting plate;

a second plurality of parallel horizontal conducting plates joined to said second vertical conducting plate at right angles, between said first vertical conducting plate and said second vertical conducting plate; wherein each of the first plurality of parallel horizontal conducting plates alternates in position vertically with said second plurality of parallel horizontal conducting plates such that they are interleaved;

a coaxial feed line having two ends and joined at a first end to an electrical power source and joined at the second end to the mounting flange;

a feed probe joined to the second end of the coaxial feed line and protruding perpendicular from the center of the mounting flange and in contact with one of the plurality of parallel horizontal conducting plates closest to the mounting flange such that the feed probe is positioned off center of the mounting flange side of the horizontal conducting plate that it is connected to by virtue of the positional arrangement and dimensions of the horizontal conducting plate relative to the mounting flange; and wherein an aperture exists at the juncture of the parallel horizontal conducting plate that is furthest from the mounting flange and the first vertical conducting plate, said aperture being perpendicular to said mounting flange;

wherein all of the horizontal conducting plates have the same spatial dimensions and the height, depth and width of the antenna is approximately one-thirtieth of a wave length ($w \approx h \approx d \approx \lambda/30$) at a selected frequency of operation.

* * * * *